United States Patent [19]

Bivins et al.

[11] Patent Number: 4,584,589

[45] Date of Patent: Apr. 22, 1986

[54] ANTENNA HAVING A RAPID ENGAGEMENT PIVOT JOINT BETWEEN THE ANTENNA REFLECTOR AND SUPPORT STRUCTURE

[75] Inventors: William F. Bivins, Annandale; Clifford Allison, Herndon, both of Va.

[73] Assignee: Radiation Systems, Inc., Sterling, Va.

[21] Appl. No.: 688,481

[22] Filed: Jan. 3, 1985

[51] Int. Cl.[4] ..... H01Q 1/08

[52] U.S. Cl. ..... 343/882; 16/358; 16/360

[58] Field of Search ..... 16/267, 358, 359, 360, 16/361; 343/881, 882, 912

[56] References Cited

U.S. PATENT DOCUMENTS

| | | | |
|---|---|---|---|
| 874,014 | 12/1907 | Kurtzon . | |
| 1,115,345 | 10/1914 | Stevernagel | 16/358 X |
| 1,382,741 | 6/1921 | Pierson . | |
| 1,695,961 | 12/1928 | Howse . | |
| 1,799,519 | 4/1931 | Laube . | |
| 1,855,245 | 4/1932 | Kuenzel . | |
| 2,219,918 | 10/1940 | Economides | 16/361 X |
| 2,282,393 | 5/1942 | Block . | |
| 2,331,806 | 10/1943 | Shakespeare . | |
| 2,522,625 | 9/1950 | Lundgren . | |
| 2,769,650 | 11/1956 | Larson . | |
| 2,873,987 | 2/1959 | Larson . | |
| 2,898,173 | 8/1959 | Squire | 16/358 X |
| 3,181,829 | 5/1965 | Larsen . | |
| 3,359,593 | 12/1967 | Lautenschlager, Jr. | 16/358 |
| 3,950,054 | 4/1976 | Ward et al. . | |
| 4,032,103 | 6/1977 | Ehrichs . | |
| 4,133,509 | 1/1979 | Kalbon et al. . | |
| 4,159,814 | 7/1979 | Fibus . | |
| 4,404,565 | 9/1983 | Gurney et al. . | |

FOREIGN PATENT DOCUMENTS

| | | | |
|---|---|---|---|
| 582669 | 9/1959 | Canada | 16/358 |
| 1559943 | 5/1970 | Fed. Rep. of Germany | 16/358 |

*Primary Examiner*—Fred Silverberg

*Attorney, Agent, or Firm*—Pollock, Vande Sande and Priddy

[57] ABSTRACT

A rapid engagement pin joint, for interconnecting two units which are intended to rotate through a limited range of angular motion relative to one another, comprises a pair of plates one of which includes a pair of slots that open into an edge thereof and the other of which has a pair of outstanding pins adapted to be inserted into the open ends of said slots. One of the slots is configured as the arc of a circle while the other slot is oriented in nonparallel diverging relation to said one slot and defines a single location, e.g., the innermost end of said other slot, about which said one slot is concentric. The pin joint can be employed to effect rapid engagement between an antenna reflector and an antenna support structure.

6 Claims, 5 Drawing Figures

FIG. 1
PRIOR ART
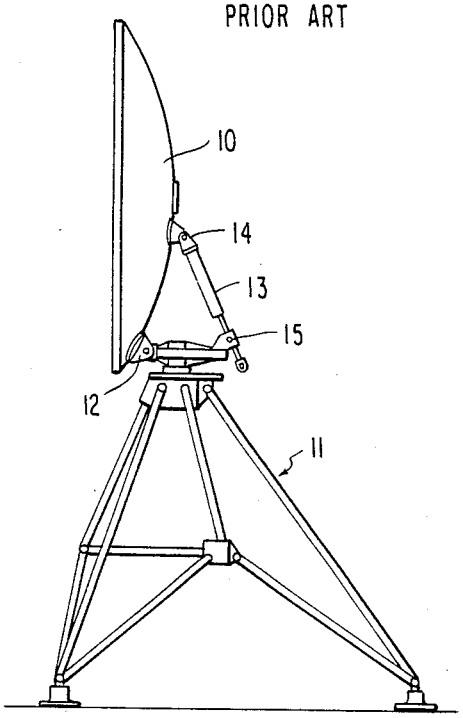
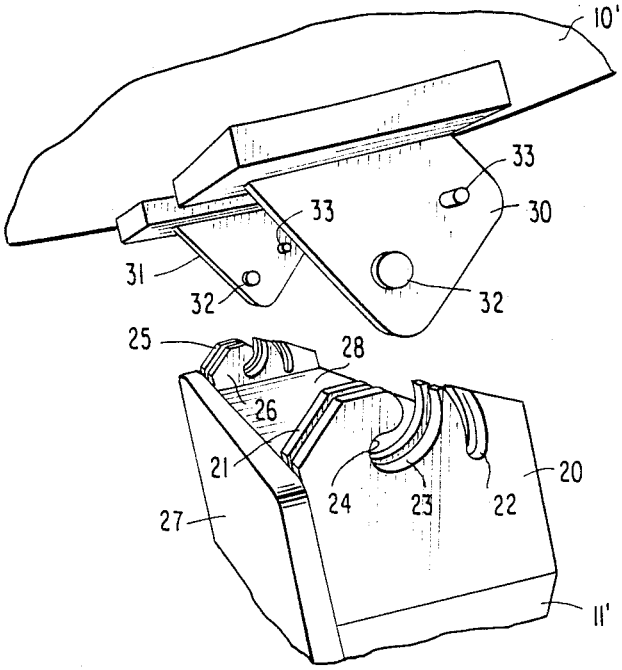
FIG. 2
FIG. 3
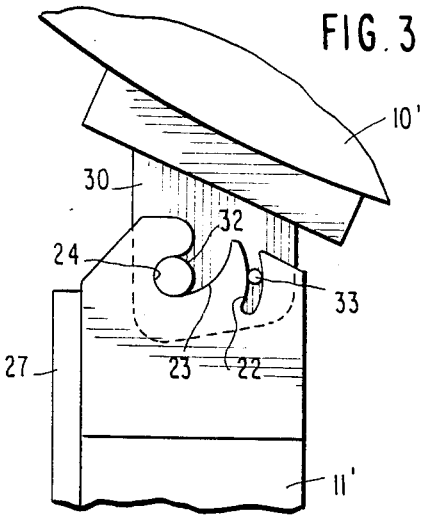
FIG. 4
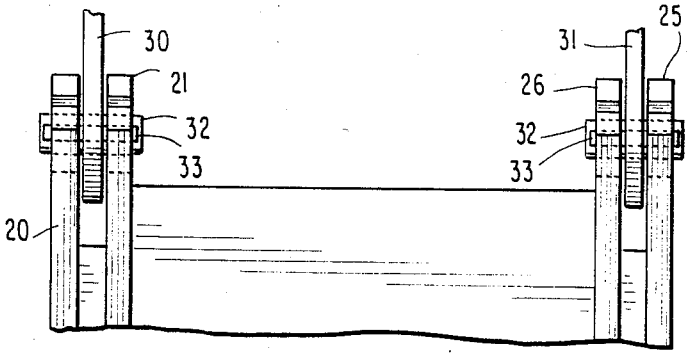
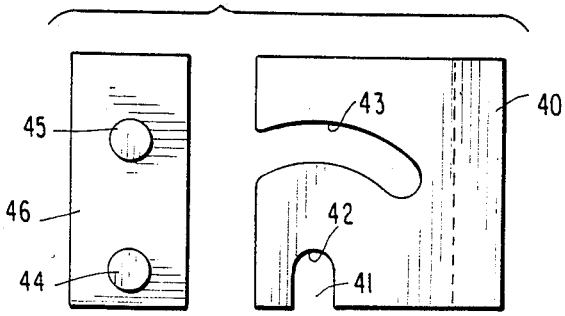
FIG. 5

ANTENNA HAVING A RAPID ENGAGEMENT PIVOT JOINT BETWEEN THE ANTENNA REFLECTOR AND SUPPORT STRUCTURE

BACKGROUND OF THE INVENTION

The present invention relates to a structure which permits the rapid coupling of assemblies to one another without the need for loose parts or precise alignment.

In the prior art, when it has been necessary to pivotally interconnect two assemblies to one another, it has been conventional to provide each assembly with a fitting having a hole therein, and to align the said holes carefully with one another whereafter a pin or bolt is inserted through the aligned holes. This procedure often gives rise to considerable difficulty and the need for multiple persons when the pivotal connection must be made between comparatively large and/or heavy parts, e.g., to pivotally interconnect an antenna reflector to an antenna support structure during the erection of an antenna unit of the type described, for example, in Gurney et al U.S. Pat. No. 4,404,565 issued Sept. 13, 1983, for "Quickly Erectable Antenna Support Structure". The situation is further complicated by the fact that the pin which is employed in effecting the pivotal connection is normally a loose part which may be misplaced and therefore unavailable when it is desired to make the pivotal connection. Although efforts have been made to minimize this latter problem by coupling the pin to one of the pivotal parts by use of a lanyard, such a lanyard restricts the easy motion of the pin and frequently breaks with the result that the pin is lost.

The present invention is intended to obviate the foregoing problems by the provision of a structural arrangement which permits a joint to be created that functions like a pinned joint through a limited range of angular motion, but which eliminates the need to carefully align holes in the parts which are to be pivotally interconnected to one another, and eliminates the need for using or inserting a separate pin into such aligned holes.

SUMMARY OF THE INVENTION

In accordance with the present invention a rapid engagement pin joint comprises at least one first plate which has a pair of spaced pins permanently attached thereto and projecting outwardly from at least one side thereof. The first plate and its pins are intended to cooperate with at least one second plate which has a pair of spaced slots therein each of which opens into an edge of the second plate, one of said slots defining a pivot location that is spaced from the open end of said one slot, e.g., the innermost end of said one slot, and the other of said slots being configured as an arc of a circle that is concentric with the said pivot location in said one slot. The spacing between the pair of pins in the first plate is chosen to be equal to the distance between the pivot location in said one slot and each point along the arcuate other slot in said second plate.

The two plates are initially disconnected from one another. When it is desired to make a pivotal connection, the plates are so positioned relative to one another that the two pins in the first plate are located in spaced relation to the aforementioned edge of the second plate, outside of the slots in the second plate. The two plates are then displaced in parallel planes relative to one another to effect insertion of one of the pins into the open end of said one slot and to slidably move said one pin along said one slot to the aforementioned pivot location. Thereafter, by displacing the two plates angularly relative to one another about said one pin acting as a pivot, the other of said pins may be slideably inserted into the open end of the arcuate other slot for movement along the arcuate path defined by said other slot.

Insertion of the second pin into its associated arcuate slot produces a stable configuration which prevents movement of the first pin away from the pivot location in the first slot, and this stable configuration persists as long as the second pin remains in its associated arcuate second slot. To assure that the second pin does not inadvertently leave its associated arcuate slot, means can be provided to limit the range of angular motion of the second pin about the first pin. When the structure is used to attach an antenna reflector to a base, e.g., in an assembly of the type disclosed in the aforementioned Gurney et patent, where the device of the present invention would, for example, replace the elevation clevis 16 shown in Gurney et al, the means for limiting the extent of angular motion of the two plates relative to one another can take the form of an elevation jack or turnbuckle that extends between the antenna reflector and support structure in the manner shown for element 3 in said Gurney et al patent.

In order to prevent lateral motion of the engaged plates relative to one another, i.e., in the axial direction of the pins, the first plate can take the form of two plates which are adjacent to but spaced from one another, and each of which is provided with a pair of slots of the type described; and the second plate, having a pair of pins which project outwardly from both sides thereof, can be dimensioned for insertion into the space between the two first plates. Such an arrangement has the advantage that the pins are placed in double shear, which strengthens the entire structure. In the alternative, the pair of first plates can be relatively widely spaced from one another, each being provided with a pair of slots of the type described, and a pair of second plates having pins thereon can be provided for cooperation respectively with said two first plates, the second plates being both located either inboard of or outboard of the said first plates.

BRIEF DESCRIPTION OF THE DRAWINGS

The foregoing objects, advantages, construction and operation of the present invention will become more readily apparent from the following description and accompanying drawings wherein:

FIG. 1 illustrates an antenna assembly of the type shown in the aforementioned Gurney et al U.S. Pat. No. 4,404,565, with which the rapid engagement pin joint of the present invention may, be employed;

FIG. 2 is a perspective view of a pin joint constructed in accordance with the present invention;

FIG. 3 is a side view of the structure shown in FIG. 2 with the parts of the pin joint in pivotal engagement with one another;

FIG. 4 is a rear view of the structure shown in FIG. 2; and

FIG. 5 illustrates an alternative embodiment of the present invention.

DESCRIPTION OF THE PREFERRED EMBODIMENTS

Referring initially to FIG. 1, an antenna of the type described in the aforementioned Gurney et al patent comprises an antenna reflector generally designated 10 which is mounted on a support structure generally designated 11, the reflector 10 being pivotally attached to support structure 11 at a pivot 12 constituting, in the prior art arrangement, a clevis having a pin extending therethrough. This pivotal connection between elements 10 and 11 is provided to permit the elevation of reflector 10 to be varied by means of an elevation jack 13 the upper end of which is pivotally connected at 14 to reflector 10 and the lower end of which is connected at 15 to support structure 11. The connection at 15 is a thread connection, and the end of jack 13 adjacent threaded member 15 includes a shackle which can be rotated by a hand crank to effectively change the length of jack 13 thereby to change the angular orientation of reflector 10 in elevation.

The arrangement described in the aforementioned Gurney et al patent, and generally shown in FIG. 1, consists of a plurality of structural members which are adapted to be assembled in the field. This assembly gives rise to the difficulties previously described herein when making the pivot joint 12. The present invention can be employed to produce a pivot connection which replaces connection 12, and will be described hereinafter in this context. However it should be understood that the pin joint of the present invention is not limited to use in the specific application illustrated in FIG. 1. When the present invention is employed in the FIG. 1 application, the extent of angular movement of the parts of the pin joint relative to one another are limited by the elevation jack 13, which assures that the pin joint of the present invention will not become disengaged as a result of excessive angular movement of the parts relative to one another. However other mechanisms, which will be apparent to those skilled in the art, can also be used to limit the extent of angular movement of the parts relative to one another.

Referring now to FIG. 2, the rapid engagement pin joint of the present invention comprises a first pair of plates 20 and 21 each of which may be fabricated, for example, of aluminum having a thickness of substantially $\frac{3}{4}$ inch, the plates 20 and 21 being disposed closely adjacent to one another but separated by a spacing of approximately one inch. Each plate is provided with a pair of slots that opens into the upper edge of the plate, one such slot 22 being configured as the arc of a circle, and the other slot 23 being nonparallel to and divergent from slot 22 and defining a pivot location 24 at the innermost end of slot 23 about which pivot location the arcuate slot 22 is concentric.

A further pair of plates 25 and 26 are also provided, which have the same construction, spacing and slotted configuration as plates 20 and 21. The two pairs of plates 20, 21 and 25, 26 are mounted in spaced relation to one another by means of structural plate members 27 and 28, with the overall unit thus formed being affixed to a base structure such as, for example, an antenna support structure which has been generally designated 11'.

The aforementioned unit cooperates with a further unit that may be affixed to, for example, a quadrant of a parabolic antenna reflector element generally designated 10'. Said further unit comprises a pair of plates 30 and 31 each of which is fabricated of aluminum, has a thickness e.g. $\frac{7}{8}$ inch dimensioned to permit plate 30 to be inserted into the space between plates 20 and 21, and to permit plate 31 to be inserted into the space between plates 25, 26, and each of which plates 30, 31 has a pair of pins 32, 33 projecting outwardly therefrom. The pins 32, 33 are preferably fabricated of stainless steel and press fit through holes provided in aluminum plates 30, 31. Each pin 32, 33 includes portions which project outwardly of both sides of its associated plate 30, 31, as best shown in FIG. 4, for cooperation with the slots in an associated pair of plates 20, 21 and 25, 26. The spacing between the pins 32 and 33 on each plate corresponds to the spacing between the innermost end 24 of slot 23 and each point along the arcuate slot 22 in the previously described first unit. In addition, inasmuch as each pin 32 is intended to be a load bearing pin in the arrangement illustrated in the drawings, with the pins 33 being provided essentially to effect guidance during the pivotal motion of the parts relative to one another, each pin 32 is larger in diameter than its associated pin 33, and each slot 23 is similarly wider than each slot 22.

In order to effect engagement of the two units shown in FIG. 2 to one another, to provide a desired pivotal connection between said units, the upper unit is manipulated into the general position shown in FIG. 2, wherein plates 30 and 31 are opposite to the spaces between the plate pairs of the lower unit and the pins 32, 33 are outside of the open ends of the slots 22, 23, and the units are then moved in generally parallel planar relation to one another to insert plate 30 into the space between plates 20, 21, and to insert plate 31 into the space between plates 25, 26, and to insert the opposing ends of each pin 32 into the open ends of the slots 23 in the plate pair of the lower unit. Continued movement of the units relative to one another in the same fashion causes the pins 32 to slide along the sides of slots 23 until they reach pivot location 24. Thereafter, by relative rotary motion of the two units about the axis of rotation defined by pins 32, the pins 33 can be inserted into the open upper ends of arcuate slots 22 for movement along said slots to a lower position defined by the innermost end of each slot 22. To prevent inadvertent movement of the pins 33 out of the upper ends of the slots 22, a further mechanism can then be engaged, e.g., a mechanism such as elevation jack 13 shown in FIG. 1, thereby to assure that the range of pivotal movement of the parts relative to one another is limited to the length of arcuate slots 22.

It will be appreciated that, by providing two slotted plates such as 20, 21 for cooperation with an intervening pin plate such as 30, lateral motion of the plate 30 relative to the slotted plates is prevented and, in addition, the pins on plate 30 are placed in double shear which strengthens the overall structure. Depending upon the particular application, lateral motion between the upper unit and lower unit can be prevented by using an alternative arrangement wherein only a single plate is provided at each end of the lower unit, e.g., plates 20 and 25 shown in FIG. 4, for cooperation with plates 30 and 31 positioned inboard of plates 20 and 25. The same effect can be achieved by a further alternative arrangement which uses only lower plates 21 and 26 with the pin plates 30 and 31 being disposed outboard of slotted plates 21, 26. Moreover, again depending upon the application, the joint may take the form of only two plates such as 20, 21 cooperating with an intervening plate such as 30, the remaining plates 25, 26 and 31 not being employed.

The arrangement shown in FIGS. 2–4 contemplates that the lower unit is so disposed that the open ends of slots 22 and 23 are disposed at the upper edge of said lower unit. However, inasmuch as a stable configuration is achieved once the pins 32 are seated at the pivot location in their associated slots 23 and pins 33 are inserted into their corresponding slots 22, the parts may be disposed in other orientations relative to one another, including a 180° reversal of the relative positions of parts shown in FIG. 2, so long as means (such as jack 13) are provided to prevent separation of the parts once they have been pivotally interconnected to one another.

The specific configurations of the slots shown in FIGS. 2-4 can also be varied. One such possible variation is shown in FIG. 5 where the two slots in a plate 40 constitute a straight slot 41 which defines a pivot location 42 at its innermost end about which an arcuate further slot 43 is concentric, the slots 41 and 43 cooperating in a manner analogous to that previously described with a pair of pins 44, 45 that project outwardly from a further plate 46. The FIG. 5 embodiment also illustrates that the widths of the slots 41, 43 may be the same, for cooperation with pins 44, 45 having like diameters.

While we have thus described preferred embodiments of the present invention, many variations will be apparent to those skilled in the art. It must therefore be understood that the foregoing description is intended to be illustrative only and not limitative of the invention, and all such variations as are in accord with the principles described are meant to fall within the scope of the appended claims.

Having thus described our invention, we claim:

1. In an antenna of the type comprising an antenna reflector which is pivotally attached to an antenna support structure to permit the elevation of said reflector to be changed, the improvement wherein said reflector is pivotally attached to said support structure by a rapid engagement joint comprising first and second units which may be readily mated with and separated from one another, said first unit being attached to said support structure, and said second unit being separate from said first unit and attached to said reflector, one of said units comprising a first vertically oriented plate having first and second slots therein, each of said slots opening at one end thereof into a horizontal edge of said vertical first plate, the open ends of said slots being spaced from one another along said horizontal edge of said first plate, the other ends of said slots being located respectively at spaced points within said first plate which are remote from said horizontal edge of said first plate, said first slot extending as the arc of a circle between its opposing ends, said second slot being wider than said first slot and being oriented in nonparallel relation to said first slot, said arcuate first slot being concentric with only the said other end of said second slot that is remote from said horizontal edge of said first plate, the other of said units comprising a second vertically oriented plate having a pair of horizontally oriented pins projecting outwardly therefom, one of said pins being a guide pin that is to be inserted into said first slot and the other of said pins being a load bearing pin that is to be inserted into said second slot, the diameter of said load bearing pin being greater than that of said guide pin, said pins on said second plate being laterally spaced from one another bt a distance equal to the distance between each point along said first slot and said other end of said second slot, said first and second units being adapted to be readily engaged with one another for pivotal motion of said reflector relative to said support structure by inserting said load bearing pin into the open end of said second slot, displacing said units to move said first and second plates relative to one another in parallel planes so as to slide said load bearing pin along said second slot until said inserted load bearing pin seats at the remote other end of said second slot, and then angularly displacing said units relative to one another to insert said guide pin into the open end of said first slot for movement along the arcuate path defined by said first slot about the axis defined by said load bearing pin while said load bearing pin remains located at said remote other end of said second slot.

2. The antenna of claim 1 wherein said second slot is of curved configuration between its opposing ends.

3. The antenna of claim 1 wherein said first unit comprises a pair of said first plates disposed in adjacent parallel spaced relation to one another, each of said first plates having said first and second slots therein, said second plate extending vertically from said antenna reflector and being dimensioned for insertion into the space between said pair of first plates, portions of each said pins projecting outwardly from opposite sides of said second plate, the pin portions projecting from one side of said second plate being insertable into the open ends of the slots in one of said first plates, and the pin portions projecting from the other side of said second plate being insertable into the open ends of the slots in the other of said first plates thereby to engage said first and second plates to one another for pivotal motion of said antenna reflector relative to said antenna support structure.

4. The antenna of claim 3 including and means interconnecting said antenna reflector and support structure to limit the extent to which said reflector may be angularly displaced relative to said support structure by said pivotal motion of said plates relative to one another.

5. The antenna or claim 1 comprising a pair of said first plates, means for fixedly mounting said pair of first plates in spaced substantially parallel relation to one another to form said a first unit, each of said first plates having said first and second slots therein, a pair of said second plates fixedly mounted in spaced substantially parallel relation to one another at a distance from one another substantially equal to the distance, between said pair of first plates to form said a second unit, each of said second plates having a pair of said pins projecting outwardly therefrom, the pins of one of said second plates being insertable into the slots of one of said first plates and the pins of the other of said second plates being insertable into the slots of the other of said first plates thereby to engage said first and second units with one another for pivotal motion relative to one another.

6. The antenna of claim 5 wherein said first unit comprises two pairs of said first plates disposed respectively in spaced relation to one another, said pair of second plates in said second unit being dimensioned and so located relative to one another that one of said second plates is insertable into the space between one of said pairs of first plates and the other of said second plates is simultaneously insertable into the space between the other of said pairs of first plates.

* * * * *